US006360471B1

(12) United States Patent
Stein

(10) Patent No.: US 6,360,471 B1
(45) Date of Patent: Mar. 26, 2002

(54) AIMING DEVICE FOR USE ON GUN OR OTHER PROJECTILE-FIRING DEVICE

(76) Inventor: Lawrence Stein, 8843 Alcott St., #4, Los Angeles, CA (US) 90035

( * ) Notice: Subject to any disclaimer, the term of this patent is extended or adjusted under 35 U.S.C. 154(b) by 0 days.

(21) Appl. No.: 09/394,459

(22) Filed: Sep. 11, 1999

(51) Int. Cl.[7] ..... F41G 1/12
(52) U.S. Cl. ..... 42/122; 42/130; 42/141
(58) Field of Search ..... 42/111, 112, 113, 42/122, 130, 141, 144

(56) References Cited

U.S. PATENT DOCUMENTS

| | | | | |
|---|---|---|---|---|
| 3,698,091 A | * | 10/1972 | Merrill et al. | 42/144 |
| 4,601,121 A | | 7/1986 | Jolly | 42/100 |
| 5,426,882 A | * | 6/1995 | Dornaus | 42/137 |
| 5,519,941 A | | 5/1996 | Yusko | 33/252 |
| D382,038 S | | 8/1997 | Nigh | D22/109 |
| D392,015 S | | 3/1998 | Emerson | D22/109 |
| D406,631 S | | 3/1999 | Emerson | D22/109 |
| 6,058,616 A | * | 5/2000 | Bubits | 42/111 |

OTHER PUBLICATIONS

Ayoob, "Steyr M9", Guns, pp. 52, 57, 59, 96, 97, Oct. (1999).

* cited by examiner

*Primary Examiner*—Stephen M. Johnson
(74) *Attorney, Agent, or Firm*—Dennis M. Flaherty

(57) ABSTRACT

An aiming device which incorporates into its sight picture a corner shape for aligning with the target, and which aligns two components to form a meaningful shape or image. Meaningful is defined as a shape or image readily recognizable to the one aiming the device, such as a triangle, teardrop, arrowhead, spade shape (as seen in playing cards), rhombus, rectangle, square or any other shape that is easily recognized as a distinctive shape to the person aiming.

18 Claims, 3 Drawing Sheets

AIMING DEVICE FOR USE ON GUN OR OTHER PROJECTILE-FIRING DEVICE

FIELD OF THE INVENTION

This invention generally relates to aiming devices. In particular, the invention relates to sighting configurations for use on firearms and other projectile-firing devices.

BACKGROUND OF THE INVENTION

Aiming any projectile weapon such as a firearm (and handguns in particular) generally requires the use of an aiming device. For the past 200 years or so, nearly all firearms sights have been based on one unchanged system: a front sight post 10 (see FIG. 1) supported by a front section of a support structure 14 (e.g., the barrel, slide or frame of a gun) is aligned with a rear sight "notch" 12 supported by a rear section of the support structure 14. To accurately aim using the standard notch and post system, one looks at the front post sight 10 and centers that post 10 vertically and horizontally, in the notch of the rear notch sight 12, as shown in FIG. 2. This sight picture is then aligned with the target 16 to ensure an accurate hit. FIG. 2 shows a front post 10 and a rear notch sight 12 in proper alignment with each other and with the target 16.

This method of aiming is so pervasive that some form of it is on nearly every firearm in existence. Despite the nearly universal acceptance of the notch and post system, it has a number of serious shortcomings. Many competition shooters and handgun hunters recognize these shortcomings and bypass the problems altogether. They equip their firearms with high-priced optical or red-dot style sights that are large, heavy, and bulky. They must acquire special holsters to accommodate these sights, as well as special rails on which to mount them. Despite these inconveniences, they still use them. This is a testament to the serious shortcomings of traditional notch and post sights.

However, the majority of shooters do not equip their firearms with optical sights, since their advantages are negated by their cost, size, and weight, and the need for special mounting equipment and holsters. While it is true that notch and post sights are size-efficient, cost-effective and convenient, they offer some major shortcomings, including the following:

(a) When the notch and post sights are aligned, they do not form a meaningful shape to the shooter; rather, the sights form a series of meaningless lines and/or dots. This translates into a poor level of feedback as to the state of sight alignment, particularly in an emergency situation.

(b) The rear notch is many times larger than the front post, thereby distracting the shooter's attention from the more important front sight.

(c) Conversely, the front post is unduly small, making it difficult to see easily.

(d) Because the rear notch and front post are identical in height, it is possible that the front sight can become completely obscured behind one of the "shoulders" of the rear notch.

(e) While the front sight post is quite small, the overall silhouette of both sights when aligned together is relatively large and can obscure significant areas of the target.

(f) Notch and post sights are inherently less accurate since their aiming surface is either the flat top of a rectangular post or an even less precise dot. Either one of these shapes can cover significant area on the target, especially at long distances. This makes it more difficult to aim at a small or extremely specific part of a target.

(g) Acquiring a proper sight picture is relatively slow with notch and post sights.

(h) Aiming in low light is difficult (even with luminescent inserts on the sights) because the silhouette of properly aligned notch and post sights is very difficult to identify.

(i) Notch and post style sights are overly complex to align, requiring the alignment of no less than four aiming surfaces.

(j) During recoil, a firearm is lifted upwards and away from the target. The front sight post is small and difficult to find while the firearm is bobbing and moving from recoil, yet alignment of the sights and target must be re-established before the next shot can be fired. The notch and post configuration makes for slower rapid-fire shooting both in emergency and competition situations.

(k) Notch and post handgun sights generally fail under stress. It is an established fact that even when trained solely in the use of sighted-fire methods, very few gunfight survivors ever remember seeing their sights at all.

There have been other sight configurations, especially for handguns, besides notch and post sights that have seen very limited success among firearms owners. For example, U.S. Design Pat. Nos. 406,631 and 392,015 to Emerson disclose "express" style sights. This sighting configuration is faster than the notch and post configuration, but is inherently far less accurate. The large, round front sight offers no specific surface with which to aim on the target, and it obscures a great deal of target area. Further, it is not possible to determine precisely where the shot will impact. And even though the front dot is significantly larger than a traditional post, it is still small in relation to the rear sight.

Other sighting configurations have been available, but have not gained acceptance among shooters, either because of lack of advantages over notch and post style sights, an impractical size or cost, or a combination of the above factors. One example is the sighting configuration disclosed in U.S. Pat. No. 4,601,121 to Jolly. While it offers the precision of a corner for the aiming surface and increased visibility, it is unduly large, bulky and obtrusive. It cannot be mounted easily on a firearm. If it is mounted on a handgun, it will not fit in most holsters. There may be mechanical issues to be overcome if it is to be mounted on a self-loading firearm. Another example is U.S. Design Pat. No. 382,038 to Nigh. This design lends itself to becoming snagged on clothing or a holster if mounted on a handgun. The front sight is still smaller than the rear sight. This sight is still quite time consuming to align, since the triangular front sight must be precisely aligned with the notch in the rear sight. This is made difficult by the fact that the notch is much smaller than a standard notch. And finally, the apex of the triangular front sight is not precisely where the aiming takes place; rather, there is first a slight vertical space between it and the rear sight, and then another vertical space between the rear sight and the target. This affords less potential accuracy.

Thus there is a need for an aiming device which allows for rapid targeting and which is not afflicted with the foregoing disadvantages of prior art sighting configurations.

SUMMARY OF THE INVENTION

The present invention comprises an aiming device which incorporates into its sight picture a corner shape for aligning with the target, and which aligns two components to form a meaningful shape or image. Meaningful is defined as a shape or image readily recognizable to the one aiming the device, such as a triangle, teardrop, arrowhead, spade shape (as seen in playing cards), rhombus, rectangle, square or any other shape that is easily recognized as a distinctive shape to the person aiming.

The aiming device in accordance with the preferred embodiments will be described with reference to a stiff support structure having front and rear sections through which a longitudinal axis passes. The front sight is supported by the front section of the support structure, while the rear sight is supported by the rear section of the support structure. In the case of firearms, the support structure will consist of a portion of the firearm, for example, a barrel, slide or frame assembly. In accordance with the preferred embodiments of the present invention, the front sight comprises a facet having a first shape when viewed from a vantage point to the rear of the rear section of the support structure. That first shape is bounded in part by a juxtaposition boundary and comprises a first vertex which constitutes the portion of the front sight furthest removed from the longitudinal axis. The rear sight comprises a facet having a second shape when viewed from the same vantage point. That second shape is also bounded in part by a juxtaposition boundary. As used herein, the term "juxtaposition boundary" refers to respective portions of the boundaries of the first and second shapes which can be placed in juxtaposition to each other. In accordance with the preferred embodiments, the juxtaposition boundaries of the front and rear sights are substantially congruent when viewed from said vantage point, and the first and second shapes together appear as a polygonal shape having at least three vertices (one being the aforementioned first vertex) when the respective juxtaposition boundaries are visually juxtaposed. The sights are configured and mounted so that their juxtaposition boundaries are visually juxtaposed when viewed from said vantage point only when a line of sight of the viewer is substantially parallel to the longitudinal axis of the support structure, e.g., the centerline of the barrel bore of a gun. The front and rear sights are further configured so that the polygonal shape resulting from juxtaposition is bounded in part by a first straight line extending from the first vertex to a second vertex, and by a second straight line extending from the first vertex to a third vertex, and has a maximum width along an axis intersecting the second and third vertices. In accordance with the most preferred embodiment, the polygonal shape is a triangle having an apex at the aforementioned first vertex.

In accordance with a further feature, the aforementioned facet of the front sight is disposed at an acute angle relative to the longitudinal axis, the first vertex being the point on the front sight facet furthest removed from the rear sight.

The present invention also encompasses any projection device incorporating an aiming device of the type described above. The invention has application in guns, rifles, cannon, archery bows, laser guns, machine guns, and so forth.

If desired, the aiming device may be made adjustable for windage and elevation by attaching the device to any mechanism that will accomplish this, such as a pad which moves in the vertical and/or horizontal planes when adjusting screws are turned.

DETAILED DESCRIPTION OF THE PREFERRED EMBODIMENTS

Figure 1:
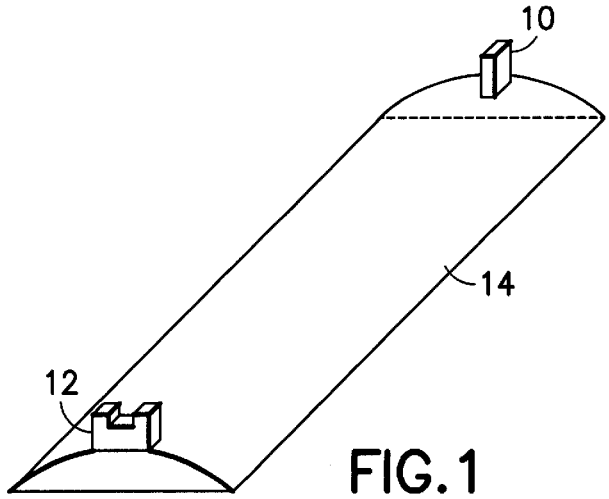
FIG. 1 PRIOR ART
FIG. 1 is a schematic showing an isometric view of a conventional sighting configuration for use on a gun or other projectile-firing device.
Figure 2:
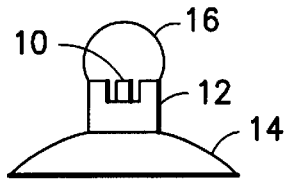
FIG. 2 PRIOR ART
FIG. 2 is a schematic showing a view along the line of sight of the sighting configuration depicted in FIG. 1 when aimed at a target.
Figure 3:
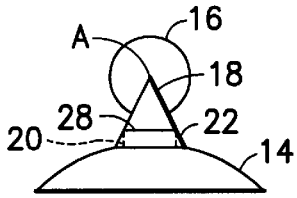
FIG. 3 is a schematic showing a view along the line of sight of a sighting configuration in accordance with one preferred embodiment of the invention.
Figure 4:
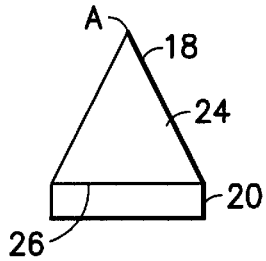
FIG. 4 is a schematic showing a rear view of a front sight of the sighting configuration depicted in FIG. 3.

In accordance with one preferred embodiment of the invention shown in FIG. 3, the aiming device comprises a stiff support structure 14 comprising front and rear sections, with a longitudinal axis passing through said front and rear sections, a triangular front sight 18 disposed on a base 20 (as best seen in FIG. 4), which base is in turn supported by the front section of the support structure, and a trapezoidal rear sight 22 supported by the rear section of the support structure. Preferably the front sight is in the shape of the upper portion of an isosceles triangle 24 while the rear sight is in the shape of the bottom portion of that isosceles triangle, the latter forming a polygonal shape which is intuitively recognized by the person aiming when the sights are juxtaposed. The [base] baseline 26 of the front sight triangle 24 defines a straight line having a predetermined length; the top 28 of the rear sight trapezoid defines another straight line having the same predetermined length. Lines 26 and 28 constitute juxtaposition boundaries which are juxtaposed to properly position the sights for forming the overall triangular shape recognized by the shooter. As used herein and in the claims, the term "juxtaposition" includes both placing the juxtaposition boundaries side by side and superimposing one juxtaposition boundary on the other.

FIG. 3 depicts the front and rear sights in a state of visual juxtaposition. When viewed by the shooter, the resulting alignment of the front sight 18 with the rear sight 22 forms a triangular shape in the shooter's view. Thus, the shooter is actually making a picture to aim, rather than aligning meaningless shapes. Preferably facet 24 of the front sight is brightly colored and the rear sight is dark, so that there is a contrast between the sights. To aim, the shooter aligns in his or her view the front sight 18 with the rear sight 22, and then aligns the apex A of the resulting triangular shape that is formed with the target 16.

Although FIG. 3 depicts a rear sight 22 attached directly to the support structure 14, it will be readily appreciated that the rear sight can also be disposed on a base. Preferably, however, in that case the height of the rear sight base is such that the top of the rear sight is generally at the same elevation as the top of the front sight base. The shape of the sight bases is not critical to the present invention.

In addition, although FIGS. 3 and 4 depict front and rear sights constructed to have predetermined cross-sectional shapes for forming a polygonal shape upon sight juxtaposition, it will be readily appreciated that the respective cross-sectional shapes of the sights can deviate from the desired shapes, which are instead painted on. For example, if a desired isosceles triangle is painted on the facet 24 of the front sight 18, the boundary of the facet itself may extend beyond the boundary of that isosceles triangle. As used in the claims, the term "facet" is intended to encompass both a physical facet of a sight and a facet painted on a surface or face of a sight.

Although not shown in FIG. 4, the facet 24 of the front sight 18 is preferably disposed at an acute angle relative to the longitudinal axis of the support structure 14, the inclination being such that vertex (apex) A is the point on facet 24 furthest removed from the rear sight. In the case of FIG. 3, the longitudinal axis of the support structure 14 is perpendicular to the plane of the paper.

Figure 5:
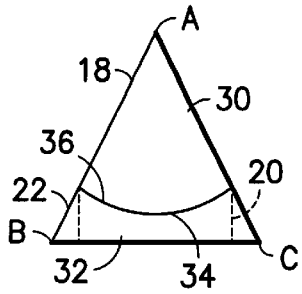
FIGS. 5–8 are schematics showing respective views along the line of sight of sighting configurations in accordance with other preferred embodiments of the invention.

The shape of the juxtaposition boundaries of the front and rear sights is not critical to practice of the invention. It is only preferred that the juxtaposition boundaries be congruent. In the embodiment shown in FIG. 3, the juxtaposition boundaries are straight lines. Alternatively, the juxtaposition boundaries may be curved, zigzagged, sinuous, stepped or other configurations. FIG. 5 depicts an exemplary embodiment in which the facet 30 of the front sight 18 is a sector having a predetermined radius of curvature, whereas the facet 32 of the rear sight 22 has a shape complementary to the sector shape of facet 30 for forming a polygonal shape, namely, an isosceles triangle having vertices A, B and C, when the juxtaposition boundaries 34 and 36 of the front and rear sights are juxtaposed. The juxtaposition boundaries 34 and 36 are both arcs having the predetermined radius of curvature.

Figure 8:
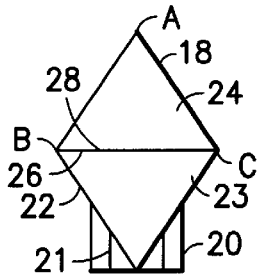

In accordance with a further preferred embodiment depicted in FIG. 8, the front sight 18 has a triangular (preferably isosceles) facet 24 (as in FIG. 3) disposed on a somewhat narrower base 20, while the rear sight 22 has an inverted triangular (preferably isosceles) facet 23 disposed on a base 21. When viewed from a vantage point to the rear of the rear sight (as shown in FIG. 8) and when the juxtaposition boundaries 26 and 28 are juxtaposed, the facets 23 and 24 form a polygonal shape which is a rhombus. In this and all other preferred embodiments, juxtaposition boundaries are visually juxtaposed only when a line of sight of the viewer is substantially parallel to said longitudinal axis of said support structure. The maximum width of the rhombus equals the distance from vertex B to vertex C. After sight juxtaposition has been achieved as shown in FIG. 8, the vertex (apex) A can be visually superimposed on the target by the shooter.

Figure 6:
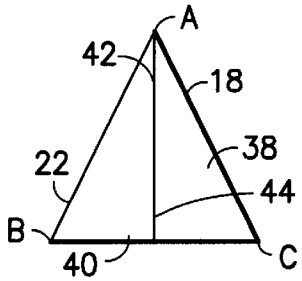

A further preferred embodiment is shown in FIG. 6. In this case the front and rear sights are situated on the front and rear sections of the support structure respectively, but on opposite sides of a plane of symmetry intersecting the longitudinal axis. The front sight 18 has a facet 38 in the shape of a right triangle and the rear sight 22 has a facet 40 which is also in the shape of a right triangle. When viewed from a vantage point to the rear of the rear sight (as shown in FIG. 6), the triangles of facets 38 and 40 preferably appear to be identical. Respective straight edges of the facets 38 and 40 form the juxtaposition boundaries 42 and 44. When the juxtaposition boundaries 42 and 44 are juxtaposed as shown in FIG. 6, the facets 38 and 40 form an isosceles triangle with vertices A, B and C.

Figure 9:
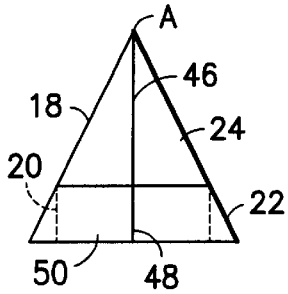
FIG. 9 is a schematic showing a view along the line of sight of the sighting configuration of FIG. 3 with alignment marks added.

In accordance with a further preferred embodiment, alignment of the front and rear sights can be assisted by placing alignments marks or stripes on the facets which form the final recognizable polygonal shape. For example, FIG. 9 depicts the embodiment of FIG. 3 wherein a central alignment line 46 is formed on the facet 24 of the triangular front sight and a central alignment line 48 is formed on the facet 50 of the trapezoidal rear sight 22. The final recognizable polygonal shape can be brought into view by first juxtaposing portions of the juxtaposition boundaries and then sliding the visible facets relative to each other in a lateral direction until central alignment lines 46 and 48 are aligned as shown. Obviously marks other than lines can be used for alignment. Also the alignment marks need not be located centrally.

Figure 7:
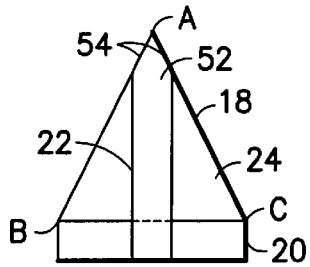

In accordance with a further preferred embodiment shown in FIG. 7, the rear sight 22 is partially superimposed on the front sight 18 when the juxtaposition boundaries of the respective sights are juxtaposed. In this embodiment, the front sight may be the same as that shown in FIG. 4. The rear sight 22, however, has a facet 52 in the shape of a post with a pointed tip terminating at vertex A. The two straight lines which form the pointed tip of the rear sight facet constitute the juxtaposition boundary of the rear sight, whereas the corresponding portions of the sides of the triangular facet 24 of the front sight extending from the apex A constitute the juxtaposition boundary of the front sight. When these juxtaposition boundaries 54 are juxtaposed, the rear sight facet 52 superimposed on the front sight facet 24 gives the appearance of an arrowhead. The apex A of the arrowhead is then visually superimposed on the target during aiming.

In accordance with the preferred embodiments, when the sight elements are interfaced or juxtaposed, a meaningful, i.e., recognizable, shape is formed when viewed by the person aiming. Preferably, the front sight has a corner shape at its apex which is visually superimposed on the target during aiming. While the apex preferably is a point, it may include a slight flat area as long as a point is generally seen for aiming purposes. Alternatively, the corner shape can be formed by the juxtaposition of two or more sight elements. While the aiming surface is a corner shape, the overall image can be any other shape, such as a rhombus, an arrowhead, a triangle, a sector, or other recognizable shapes. In addition, the front and rear sights may come in any color variations.

In accordance with further features, one or both sights may be fabricated from light-transmitting or translucent material. Also, one or both sights may be illuminated by a lamp or using luminescent material on the respective facets. One or both sights may be adjustable in conventional manner to compensate for windage and elevation. One or both sights may be colored in any manner to improve visibility, e.g., by using contrasting colors for the front and rear sights or by using bright colors for both sights.

Figure 10:
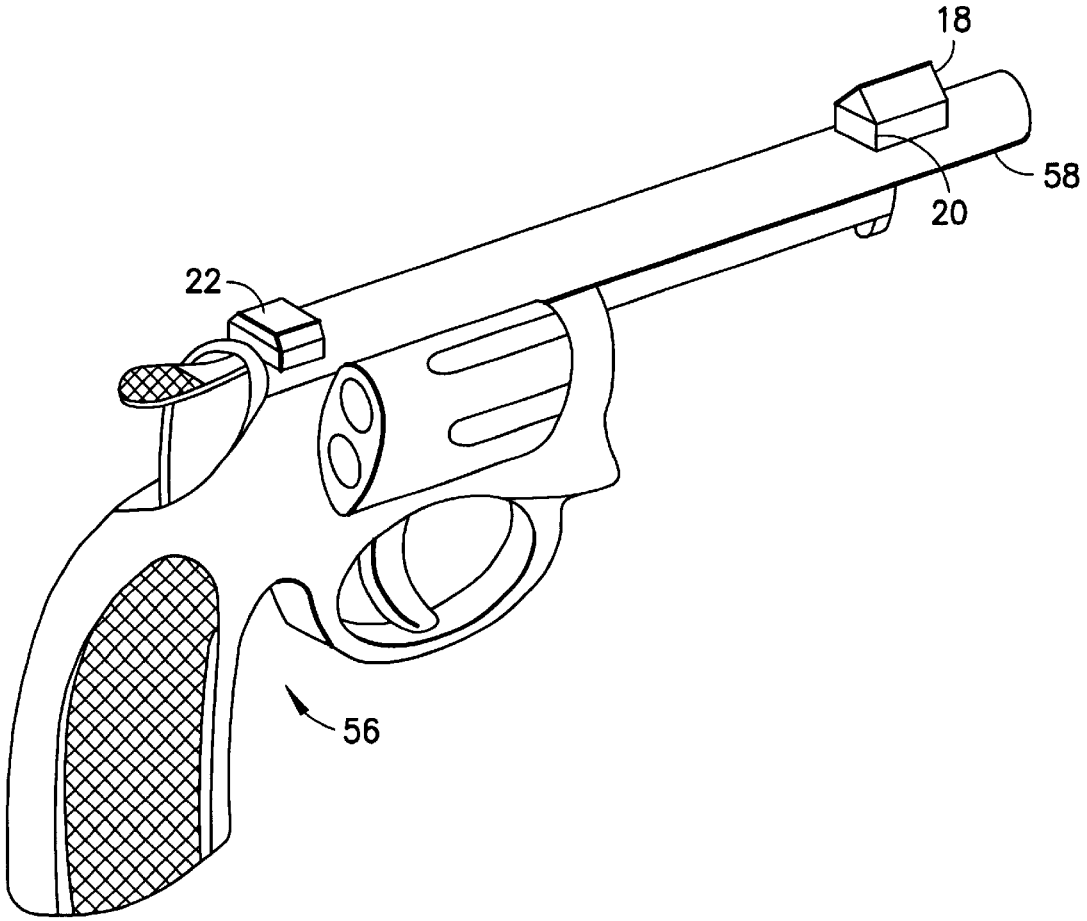
FIG. 10 is a schematic showing an isometric view of a gun which incorporates a sighting configuration of the type shown in FIG. 3.

Any one of the foregoing preferred embodiments can be incorporated in a projectile-firing device. FIG. 10 shows the sighting configuration of FIG. 3 mounted on a barrel 58 of a gun 56. The invention, however, has application in guns, rifles, cannon, archery bows, laser guns, machine guns, and so forth.

The aiming system disclosed herein has the following advantages of prior art sighting configurations:

(a) Proper alignment of this aiming system forms a shape that is meaningful to the shooter. This speeds sight alignment, as the mind tends to align meaningful shapes intuitively. In essence, the shooter is making a picture rather than aligning a series of meaningless bars, lines, or dots.

(b) The front sight, which is critical to accuracy, is much larger than the rear sight, and several times larger than traditional notch and post sights. This naturally draws attention to the front sight.

(c) The rear sight is tiny by comparison to notch and post sights, yet it is still clearly visible. Again this draws attention to the front sight.

(d) It is impossible for the front sight to become obscured behind the rear sight because there are no "shoulders" on the rear sight, and the rear sight is only a fraction of the height of the front sight.

(e) While the overall sight silhouette is much smaller, the front sight is much larger than traditional notch and post sights and other prior art designs. This results in a simultaneous increase in sight visibility and target visibility.

(f) Because the sight picture has a relatively sharp apex, aiming is extremely precise—far more precise than on notch and post sights which rely on a relatively blunt aiming surface.

(g) Because the front sight cannot be obscured by the rear sight, the front sight is so much more visible than notch and post style sights, and making a picture is intuitive, acquiring a sight picture is extremely quick.

(h) Aiming in low light is relatively easy. When the sights are aligned, they form a meaningful shape, which the shooter can easily identify by its silhouette even in extremely low light. This is true with or without the use of luminescent substances (such as tritium) on the front and/or rear sights.

(i) This aiming system cuts the required aiming coordinates in half; instead of four surfaces to align, there are only two, thereby greatly simplifying the aiming process.

(j) The front sight is much larger and more conspicuous than commonly used sights. Accordingly, during recoil, the shooter can maintain a view of the front sight easily and reacquire a sight picture much faster. This makes it far better suited to rapid firing than prior art sights.

(k) The likelihood of seeing and using this aiming system under the stress of a life-threatening self-defense situation is far greater than with notch and post sights. This is because: 1) it forms an easily recognizable shape which is meaningful to the shooter; 2) the front sight is many times larger than notch and post sights; 3) the silhouette can be aimed even when the front and rear sights are hard to see in low-light conditions; and 4) aiming is simpler, since there are only two coordinates to align (instead of four).

A further advantage is that the person using these sighting configurations has a natural tendency to want to align the sight, so that sight alignment occurs almost intuitively. In addition, the aiming device is small, and will fit standard holsters with no need to buy new holsters. Also, the production price is comparable with currently available, inexpensive notch and post style sights.

Thus, the aiming device of the invention is economical, faster to acquire, and easier to see. It forms a meaningful shape to the person aiming, improves the visibility of the front sight, increases the overall visibility of the sights and the target, increases potential accuracy, increases low-light capabilities, simplifies aiming by cutting the aiming coordinates in half, uses a front sight that cannot be obscured by the rear sight, and greatly increases the likelihood of actually seeing the sights under emergency or stressful conditions.

The aiming device described hereinabove can be manufactured out of any appropriate material such as metal or hard plastic. Also, the aiming device can be manufactured as a stand-alone, add-on unit for retro-fitting on an existing apparatus or can be manufactured as an integral part of the apparatus requiring aiming. For example, this aiming device can be sold as an after-market sight set for a handgun, or it can be manufactured integral to a handgun, as is currently the case with many snub-nosed revolvers that have notch and post sights machined into them. The aiming device may be attached to the gun by any method, for example, by machining as part of the barrel, screws or pins, soldering or brazing, clamps, dovetail attaching brackets, or magnets.

While the invention has been described with reference to preferred embodiments, it will be understood by those skilled in the art that various changes may be made and equivalents may be substituted for elements thereof without departing from the scope of the invention. For example, it should be obvious to any person skilled in the art of target shooting that the top of the polygonal shape formed by the correctly juxtaposed front and rear sights need not be a precise point, but rather may be slightly flat so long as the top portion of the polygonal shape has the shape of a corner. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An aiming device comprising:

a stiff support structure comprising front and rear sections, said support structure having a longitudinal axis passing through said front and rear sections;

a front sight supported by said front section of said support structure, said front sight comprising a facet having a first shape when viewed from a vantage point to the rear of said rear section of said support structure, said first shape being bounded in part by a first juxtaposition boundary and comprising a first vertex which constitutes the portion of said front sight furthest removed from said longitudinal axis; and a rear sight supported by said rear section of said support structure, said rear sight comprising a facet having a second shape when viewed from said vantage point, said second shape being bounded in part by a second juxtaposition boundary, wherein said first and second juxtaposition boundaries are substantially congruent when viewed from said vantage point, said first and second shapes together appearing as a polygonal shape comprising said first vertex and second and third vertices when said first and second juxtaposition boundaries are visually juxtaposed, said first and second juxtaposition boundaries being visually juxtaposed when viewed from said vantage point only when a line of sight of the viewer is substantially parallel to said longitudinal axis of said support structure, and said polygonal shape being bounded in part by a first straight line extending from said first vertex to said second vertex, and by a second straight line extending from said first vertex to said third vertex, and having a maximum width along an axis intersecting said second and third vertices.

2. The aiming device as recited in claim 1, wherein said polygonal shape is a triangle having an apex at said first vertex.

3. The aiming device as recited in claim 1, wherein said polygonal shape is a rhombus having an apex at said first vertex.

4. The aiming device as recited in claim 1, wherein said polygonal shape is an arrowhead having an apex at said first vertex.

5. The aiming device as recited in claim 1, wherein said facet of said front sight is disposed at an acute angle relative to said longitudinal axis, said first vertex being the point on said facet furthest removed from said rear sight.

6. A projection device incorporating an aiming device as recited in claim 1, wherein said projection device projects matter or wave energy along said longitudinal axis.

7. The projection device as recited in claim 6, comprising a barrel out which a projectile is projected, said support structure being formed by said barrel.

8. The projection device as recited in claim 6, wherein said projection device is a firearm.

9. An aiming device comprising:

a stiff support structure comprising front and rear sections, said support structure having a longitudinal axis passing through said front and rear sections;

a front sight supported by said front section of said support structure, said front sight comprising a facet having a first shape when viewed from a vantage point to the rear of said rear section of said support structure, said first shape being bounded by first and second straight lines and a first juxtaposition boundary, said first and second straight lines each terminating at a first vertex which constitutes the portion of said front sight furthest removed from said longitudinal axis, said first straight line and said first juxtaposition boundary each terminating at a second vertex, and said second straight line and said first juxtaposition boundary each terminating at a third vertex; and a rear sight supported by said rear section of said support structure, said rear sight comprising a facet having a second shape when viewed from said vantage point, said second shape being bounded in part by third and fourth straight lines and a second juxtaposition boundary, said third straight line and said second juxtaposition boundary each terminating at a fourth vertex, and said fourth straight line and said second juxtaposition boundary each terminating at a fifth vertex, wherein said first and second juxtaposition boundaries are substantially congruent when viewed from said vantage point, said first and second shapes together appearing as a polygonal shape when said first and second juxtaposition boundaries are visually juxtaposed, said first and second juxtaposition boundaries being visually juxtaposed when viewed from said vantage point only when a line of sight of the viewer is substantially parallel to said longitudinal axis of said support structure.

10. The aiming device as recited in claim 9, wherein said polygonal shape is a triangle.

11. The aiming device as recited in claim 9, wherein said polygonal shape is a rhombus.

12. The aiming device as recited in claim 9, wherein said first and third lines appear to be collinear and said second and fourth lines appear to be collinear when said first and second juxtaposition boundaries are visually juxtaposed.

13. A projection device incorporating an aiming device as recited in claim 9, wherein said projection device projects matter or wave energy along said longitudinal axis.

14. The projection device as recited in claim 13, wherein said support structure comprises a barrel out which a projectile is projected.

15. The projection device as recited in claim 13, wherein said projection device is a gun.

16. An aiming device comprising:

a stiff support structure comprising front and rear sections, said support structure having a longitudinal axis passing through said front and rear sections;

a front sight supported by said front section of said support structure, said front sight comprising a facet having a first shape when viewed from a vantage point to the rear of said rear section of said support structure, said first shape being bounded in part by a first juxtaposition boundary and comprising a first vertex which constitutes the portion of said front sight furthest removed from said longitudinal axis; and a rear sight supported by said rear section of said support structure, said rear sight comprising a facet having a second shape when viewed from said vantage point, said second shape being bounded in part by a second juxtaposition boundary, wherein said first and second juxtaposition boundaries are substantially congruent when viewed from said vantage point, said first and second shapes together appearing as a generally triangular shape when said first and second juxtaposition boundaries are visually juxtaposed, said first and second juxtaposition boundaries being visually juxtaposed when viewed from said vantage point only when a line of sight of the viewer is substantially parallel to said longitudinal axis of said support structure.

17. The aiming device as recited in claim 16, wherein each of said first and second juxtaposition boundaries is straight.

18. The aiming device as recited in claim 16, wherein each of said first and second juxtaposition boundaries is arcuate.

* * * * *